US006274976B1

(12) United States Patent
Ishigaki et al.

(10) Patent No.: US 6,274,976 B1
(45) Date of Patent: Aug. 14, 2001

(54) CATHODE RAY TUBE HAVING METAL FILM WITH HOLES LOCATED ON UPPER AND SIDE PORTIONS OF PHOSPHOR AREAS

(75) Inventors: Toshimasa Ishigaki, Chiba; Masahiro Nishizawa, Mobara; Fumio Takahashi, Mobara; Tetsuo Suzuki, Mobara, all of (JP)

(73) Assignees: Hitachi, LTD; Hitachi Device Engineering Co., LTD, both of Tokyo (JP)

( * ) Notice: Subject to any disclaimer, the term of this patent is extended or adjusted under 35 U.S.C. 154(b) by 0 days.

(21) Appl. No.: 09/215,455

(22) Filed: Dec. 17, 1998

(30) Foreign Application Priority Data

Dec. 25, 1997 (JP) ..... 9-357435

(51) Int. Cl.[7] ..... H01J 29/10

(52) U.S. Cl. ..... 313/466; 313/463; 313/473; 313/461

(58) Field of Search ..... 313/461, 462, 313/463, 464, 465, 466, 467–476

(56) References Cited

U.S. PATENT DOCUMENTS 4,651,053 * 3/1987 Katao et al. ..... 313/466
5,489,816 * 2/1996 Lee ..... 313/466
6,094,005 * 7/2000 Aibara ..... 313/470
6,140,758 * 10/2000 Matsuda et al. ..... 313/466

FOREIGN PATENT DOCUMENTS

01286236-A * 11/1989 (JP) ..... 313/461

* cited by examiner

*Primary Examiner*—Ashok Patel
*Assistant Examiner*—Mariceli Santiago
(74) *Attorney, Agent, or Firm*—Antonelli, Terry, Stout & Kraus, LLP

(57) ABSTRACT

A cathode ray tube has a metal film formed to cover phosphor areas of a phosphor layer on an inner wall of a panel portion of an envelope. The metal film is formed over an organic film resin applied to the phosphor layer, the organic film resin is baked and removed so that the metal film covers the phosphor layer, and cracks are formed in the metal film in a greater number on side portions of the phosphor areas than on an upper portion of the phosphor areas. This construction results in a cathode ray tube with a metal film that can prevent a blister phenomenon and a reduction in brightness.

4 Claims, 6 Drawing Sheets

FIG. 7

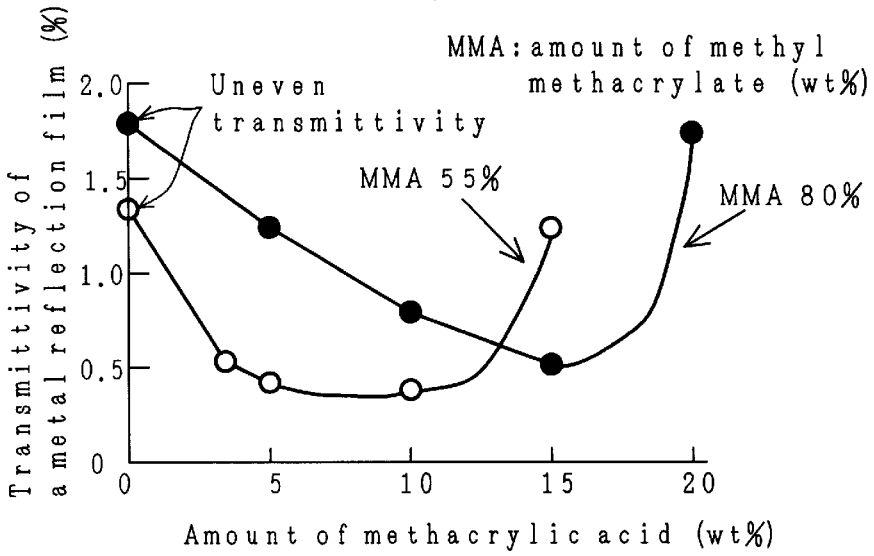

FIG. 8

Fluid characteristic of a filming solution and states of a film reflection film

| Amount of methacrylic acid (wt%) | Amount of hydroxyethyl cellulose (wt%) | Fluid characteristic | Atates of a metal reflection film |
|---|---|---|---|
| 0 | 0. 3 | Dilatancy liquid | Blisters |
| 0 | 0. 6 | Dilatancy liquid | Many cracks over phosphor |
| 3 | 0. 3 | Dilatancy liquid | Blisters |
| 3 | 0. 6 | Pseudoplastic liquid | Many cracks over phosphor |
| 8 | 0. 3 | Newtonian to pseudoplastic liquid | Good |
| 8 | 0. 6 | Pseudoplastic liquid | Many cracks over phosphor |

Composition of the filming solution:
Acrylic emulsion ... 15 wt%
Hydroxyethyl cellulose ... Indicated value
Pure water ... Remainder

CATHODE RAY TUBE HAVING METAL FILM WITH HOLES LOCATED ON UPPER AND SIDE PORTIONS OF PHOSPHOR AREAS

BACKGROUND OF THE INVENTION

The present invention relates to a cathode ray tube, and, specifically, the invention relates to an improvement in a metal film which is formed over a phosphor layer in the fluorescent screen of the cathode ray tube.

In a cathode ray tube, electron beams from electron guns are scanned on a fluorescent screen, which constitutes a display surface, to form an image on the fluorescent screen, according to the intensity of the electron beams. An evacuated envelope of a cathode ray tube typically comprises a panel portion where the fluorescent screen is formed of a number of phosphor, a neck portion housing the electron guns, and a funnel portion smoothly connecting the panel portion and the neck portion. A deflection yoke for deflecting the electron beams is arranged around the funnel portion.

The fluorescent screen formed on the inner side of the panel portion has a metal film coated thereover so as to cover the fluorescent screen. This metal film improves the brightness of the displayed image by the action of reflection and is supplied with a voltage to attract three electron beams. Normally, the metal film is called a metal reflection film or a metal back film. The metal film is formed by evaporation over an organic film resin which has been applied to the entire fluorescent screen, and then the organic film resin is removed by baking, so that the metal film remains, covering the fluorescent screen. Normally, aluminum is used for the metal film. The organic film resin is used to prevent molecules of the metal film from diffusing into the phosphor layer during the formation of the metal film, as would occur if the metal film was formed directly over the fluorescent screen.

With a cathode ray tube of the above-described construction, however, it has been pointed out that the luminance of displayed images is reduced because (1) the metal film is largely fractured, (2) the metal film as formed floats over the fluorescent screen, and (3) the metal film is not formed over a large enough area to fully cover the fluorescent screen. Our investigation into the cause of this trouble has resulted in a finding that, although an increase in the amount of organic film resin formed over the fluorescent screen results in the formation of a flat metal film without cracks or pin holes caused by degassing (generally referred to as cracks), a large amount of decomposed gas generated during the organic film resin baking process partially raises the metal film or breaks it over a wide area (hereinafter referred to as a "blister phenomenon").

Further, the organic film resin soaks into the phosphor layer. So, if the amount of the organic film resin is reduced, the organic film resin cannot cover the entire fluorescent screen. Although reducing the amount of the organic film resin can prevent the blister phenomenon in the metal film, it is found that this tends to degrade the state. of the formed metal film, leading to a reduced brightness.

The present invention has been directed to these circumstances and its objective is to provide a cathode ray tube having a metal film which is capable of preventing the blister phenomenon and reduced brightness.

Examples of a conventional cathode ray tube designed to prevent the blister phenomenon include Japanese Patent Laid-Open Nos. 191932/1982, 35834/1983 and 225723/1991.

Japanese Patent Laid-Open No. 191932/1982 discloses a technology that makes the metal film porous at corner portions and skirt portions to prevent blisters at these locations where there is no phosphor film. This publication also discloses that the drying temperature of the emulsion is differentiated between the fluorescent screen and the corner and skirt portions to make the metal film at the corner and skirt portions porous. This method, however, does not consider the prevention of blisters on the effective surface where the phosphor film is formed.

Japanese Patent Laid-Open No. 35834/1983 describes that, for the prevention of blisters, the organic film is formed by applying over the fluorescent screen a filming liquid which contains 10–20 wt% of acrylic emulsion, 0.05–0.3 wt% of propylene glycol alginate, 1–3 wt% of silicone and the remaining percentage of water, and by drying the filming liquid. It is also described that during this process the acrylic resin and the alginate separate like islands and that dislocations occur in the boundaries between the acrylic resin and the alginate, forming gaps. This technology, however, stops short of controlling the locations where the gaps occur.

Japanese Patent Laid-Open No. 225723/1991 describes that an inorganic pigment layer is formed which has relatively large raised and recessed portions in a light absorption matrix and that a part of the raised portions pierces the metal back film to form pin holes. However, it does not take into consideration the pin holes and cracks in the phosphor layer.

SUMMARY OF THE INVENTION

Representative aspects of this invention may be briefly summarized as follows.

The cathode ray tube of the present invention comprises a metal film formed to cover a phosphor layer on an inner wall of a panel portion of an envelope, wherein the metal film is formed over an organic film resin applied to the phosphor layer, the organic film resin is baked and removed so that the metal film covers the phosphor layer, and cracks are formed in the metal film in a greater number on side portions of the phosphor areas of the phosphor layer than on an upper portion of the phosphor areas. In a cathode ray tube with this construction, decomposed gases generated during the process of baking the organic film resin are released through the many cracks formed in the metal film on the side portions of the phosphor areas of the phosphor layer. Hence, the blister phenomenon can be prevented without degrading the formed state of the metal film.

The cathode ray tube of the present invention comprises: a panel portion having a black matrix layer, a phosphor layer and a metal film, all formed over the inner surface thereof, a neck portion housing electron guns for emitting electron beams; and a funnel portion connecting the panel portion and the neck portion; wherein the metal film is formed above the phosphor layer and has holes in a part thereof, with the total area of the holes on the side surface portions of phosphor areas of the phosphor layer being larger than that of those on the upper surface portion thereof.

The cathode ray tube of the present invention comprises: a plurality of openings demarcated by a black matrix layer on an inner surface of a panel; and a phosphor layer having phosphors laminated in each area of the plurality of openings; wherein a metal film having holes formed in a part thereof is formed above the phosphor layer having phosphor areas provided in the openings of the black matrix layer and the holes in the metal film are larger on side surface portions of the phosphor areas than on an upper surface side thereof.

This invention provides a cathode ray tube that requires no additional layers to prevent blisters and which can prevent a reduction in brightness of a display image.

BRIEF DESCRIPTION OF THE DRAWINGS

FIG. 7 is a graph showing the amount of methacrylic acid to be blended versus metal film transmittivity, the methacrylic acid and the metal film being used in the manufacture of the cathode ray tube of this invention.

FIG. 8 is a table showing fluid properties of the filming liquid and states of the metal film, the filming liquid and the metal film being used in the manufacture of the cathode ray tube of this invention.

DESCRIPTION OF THE PREFERRED EMBODIMENTS

Embodiments of the cathode ray tube according to this invention will be described with reference to the accompanying drawings.

Figure 2:
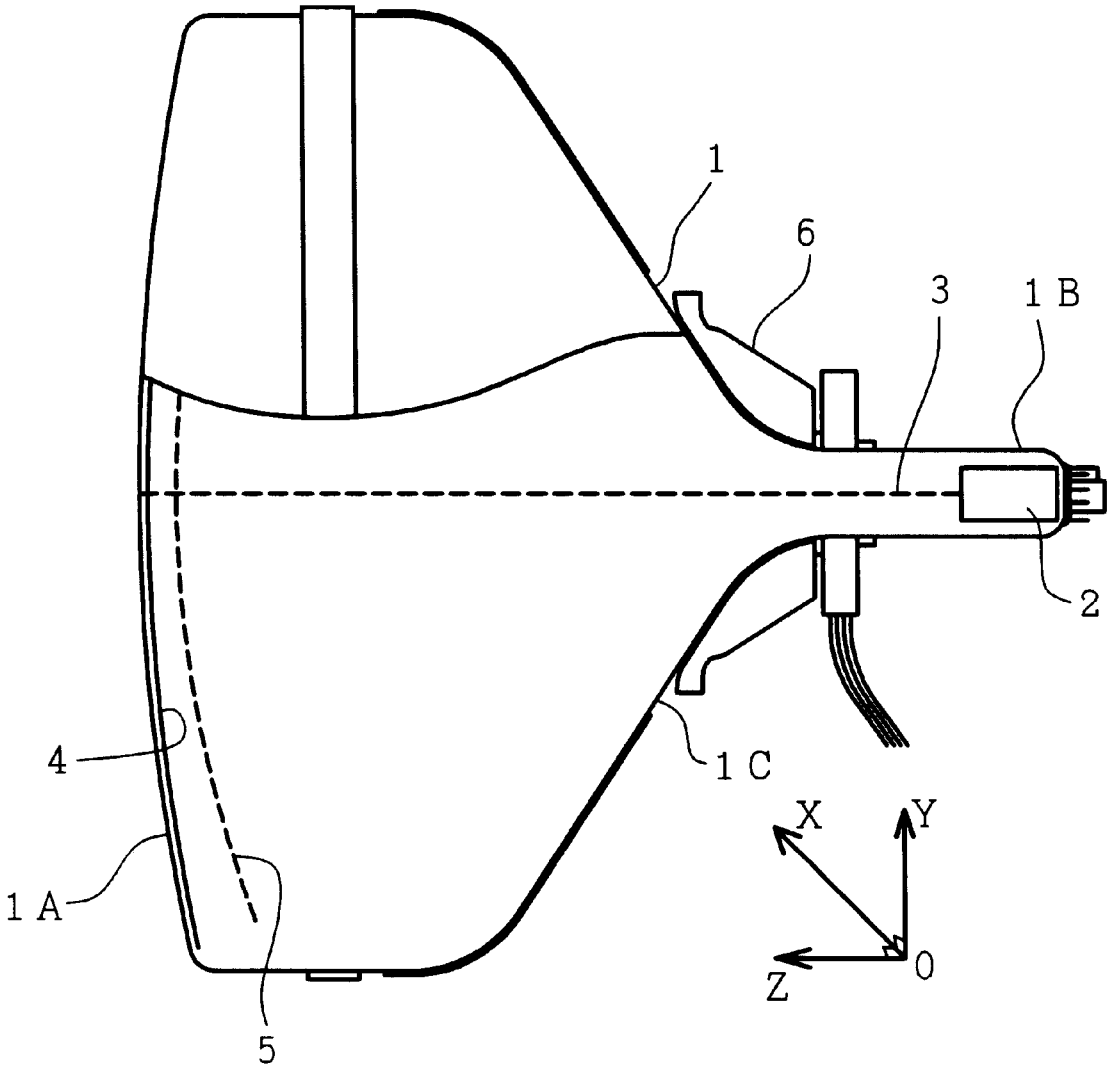
FIG. 2 is a partly cross-sectioned diagrammatic side view showing a typical cathode ray tube to which this invention is applicable.

FIG. 2 is a partly cross-sectioned side view showing a typical cathode ray tube of the type to which this invention is applicable. In the figure, there is shown an envelope 1 of the cathode ray tube, which is made of glass. The envelope 1 comprises a panel portion 1A that constitutes a display section of the cathode ray tube, a neck portion 1B housing an electron gun structure, and a funnel portion 1C smoothly connecting the panel portion 1A and the neck portion 1B. In the neck portion 1B, there is installed an electron gun structure 2, which includes three integral cathodes arranged in the horizontal direction (X direction in the figure) to emit electron beams 3, one each for the red (R), green (G) and blue (B) colors, onto the inner surface of the panel portion 1A. In the figure the horizontal direction in which the cathodes are arranged is taken as an X-axis direction, the tube axis direction of the cathode ray tube is taken as a Z-axis direction, and the vertical direction perpendicular to the horizontal and tube-axis directions is taken as a Y-axis direction.

The inner wall surface of the panel portion 1A is formed with a phosphor layer 4 in at least an effective area provided for the display of images. In each region corresponding to one color pixel, areas of phosphor for the red (R), green (G) and blue (B) colors are formed close to each other. The three electron beams 3 emitted from the electron gun structure 2 impinge on the corresponding phosphor areas.

In this arrangement, a shadow mask 5 is disposed facing the inner wall surface of the panel portion 1A over which the phosphor layer 4 is formed. The shadow mask 5 has electron beam passing holes formed therein at locations in one-to-one correspondence with the color pixels. The three electron beams 3 emitted from the electron gun structure 2 can pass through the same electron beam passing hole in the shadow mask 5. The electron beams now reach the back side of the shadow mask 5 and impinge on the phosphor areas of corresponding colors in one color pixel that is situated at a position corresponding to that electron beam passing hole.

On the outer side of the envelope 1 at the funnel portion 1C, there is mounted a deflection yoke 6, which deflects the electron beams 3 emitted from the electron gun structure 2 in the horizontal and vertical directions. The electron beams, as they scan over the screen, form an image on the screen.

Figure 3:
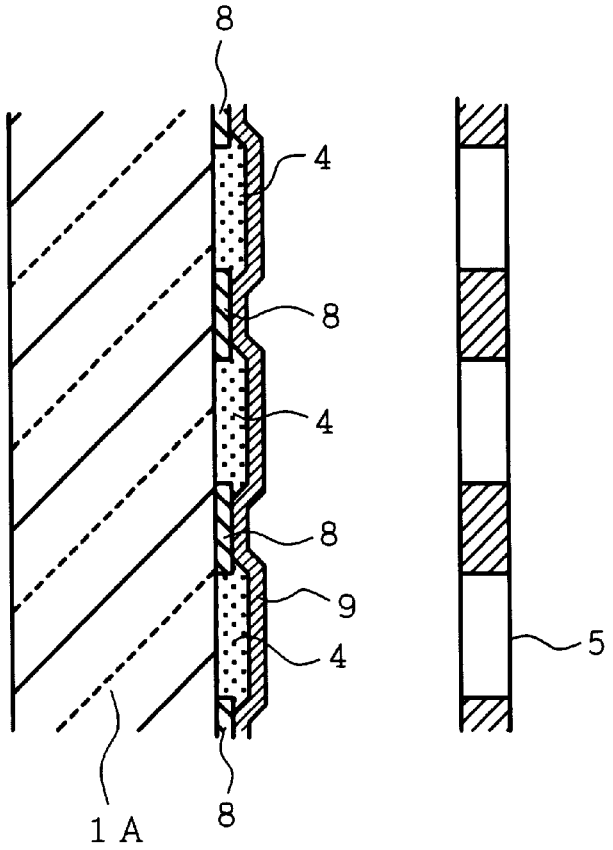
FIG. 3 is a cross section of a fluorescent screen showing one embodiment of this invention.

FIG. 3 is a cross section showing details of a portion of the phosphor layer 4 formed on the inner wall surface of the panel portion 1A of the envelope. In the figure, a black matrix layer 8 made of graphite is formed over the inner wall surface of the panel portion 1A. The black matrix layer 8 is formed to border the circumference of each pixel region. Hence, openings are formed in the black matrix layer 8 to expose the panel portion 1A at locations corresponding to individual phosphor layer regions. The phosphor layer 4 is formed above the surface of the panel portion 1A and the individual phosphor areas thereof are formed at the openings of the black matrix layer 8, and the circumferences of the phosphor areas are such that they overlap the black matrix layer 8 to a certain extent. A metal film 9 of, for example, aluminum is formed over the entire upper surface of the phosphor layer 4 and of the black matrix layer 8 exposed between the individual phosphor areas.

Figure 1A:
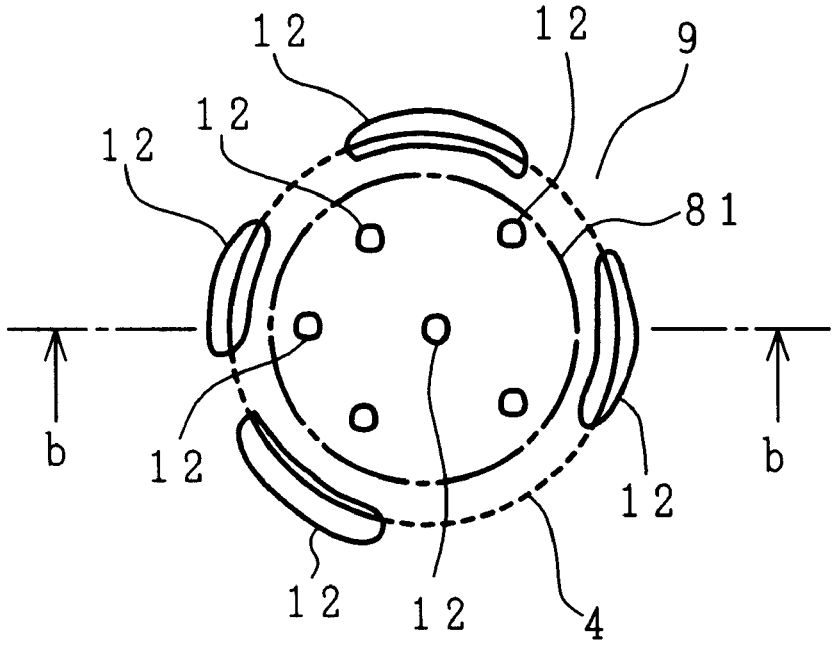
FIG. 1A is a plan view of a phosphor layer area in a dot array according to one embodiment of this invention.
Figure 1B:
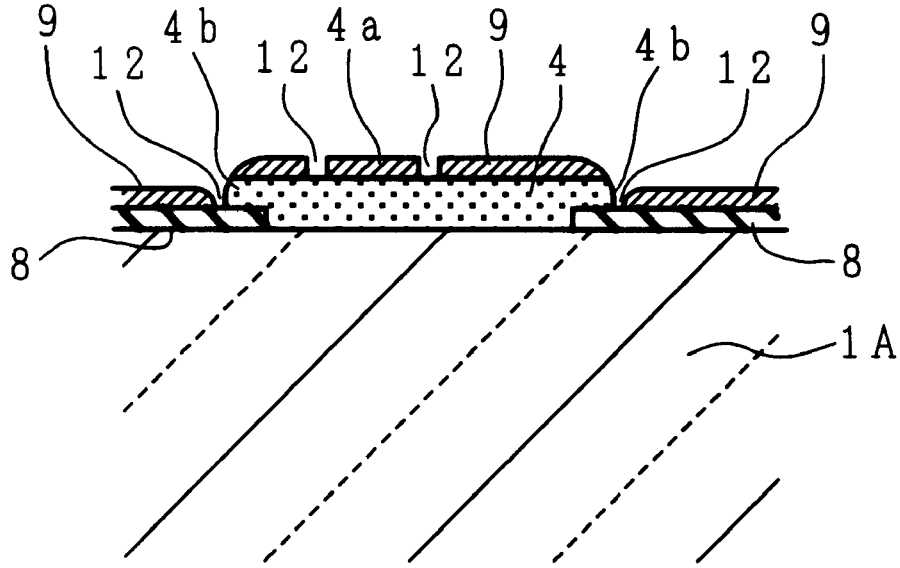
FIG. 1B is a cross-section taken along the line b—b in FIG. 1A.
Figure 9:
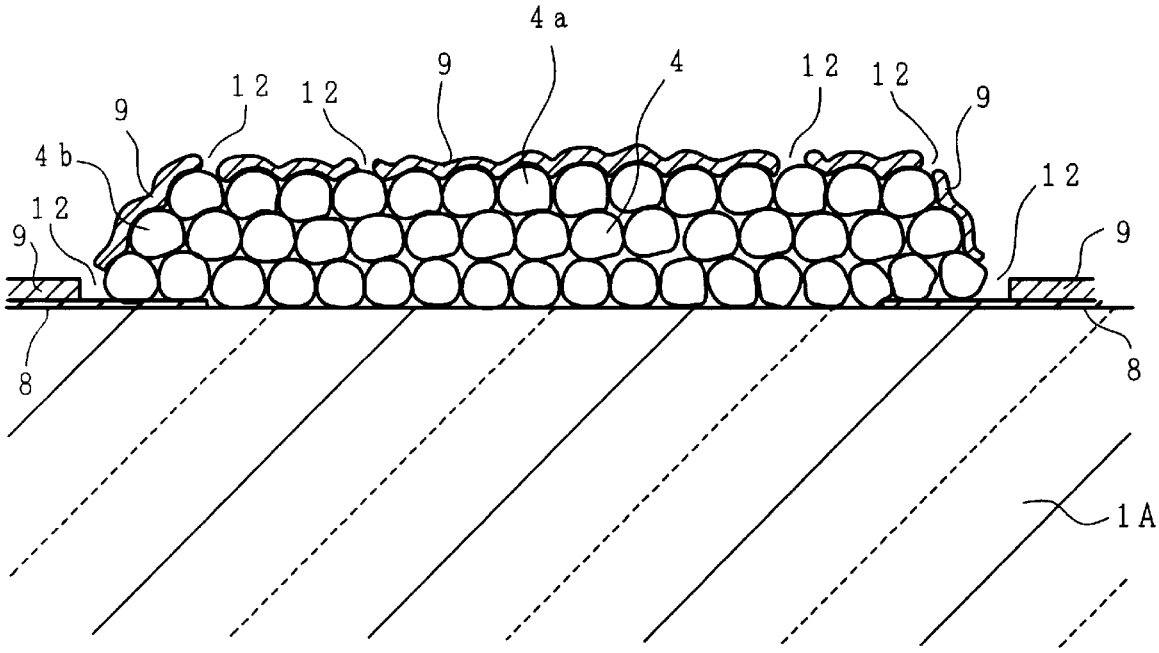
FIG. 9 is a detailed sectional view of the fluorescent portion shown in FIG. 1B.

FIGS. 1A and 1B provide a magnified view of the structure of FIG. 3, and the metal film 9 is constructed as shown therein. FIG. 1A is a plan view of one of the phosphor areas of the phosphor layer 4 arranged in a dot array, as seen from the shadow mask 5, and FIG. 1B is a cross section taken along the line b—b of FIG. 1A. The details of the construction of FIG. 1B are shown in FIG. 9, in which elements corresponding to those of FIG. 1B are denoted by like reference numbers. As seen in FIG. 9, there are gaps between phosphor particles.

In these figures the phosphor layer 4 is formed as phosphor areas laminated over the panel portion 1A (partly over the black matrix layer 8), so that each area has an upper surface portion 4*a* and side surface portions 4*b*. The metal film 9 covers not only the upper surface portion 4*a* of the phosphor layer 4, but also the side surface portions 4*b*. The metal film 9 is formed with cracks 12 to permit escape of decomposed gases generated during the process of baking the organic film resin. There are typically more cracks 12 on the side surface portions 4*b* of the phosphor layers 4 than on the upper surface portion 4*a*. However, it is only necessary for the total area of the cracks 12 to be larger on the side surface portions 4*b* than on the upper surface portion 4*a*, as seen in FIG. 1A. One way to accomplish this is for the side surface portions 4*b* to have larger cracks 12 than those on the upper surface portion 4*a*.

It is preferred in particular if the cracks 12 formed on the side surface, portions 4*b* are located outside the opening 81 of the black matrix layer 8. That is, with the cracks 12 formed above the area where the black matrix layer 8 is formed, a reduction in brightness can be prevented, assuring images to be displayed on the panel outer surface in good condition. When the cracks 12 formed in the metal film 9 are measured in terms of transmittivity, the value of the transmittivity ranges from 0.1% to 1.0%.

Figure 4:
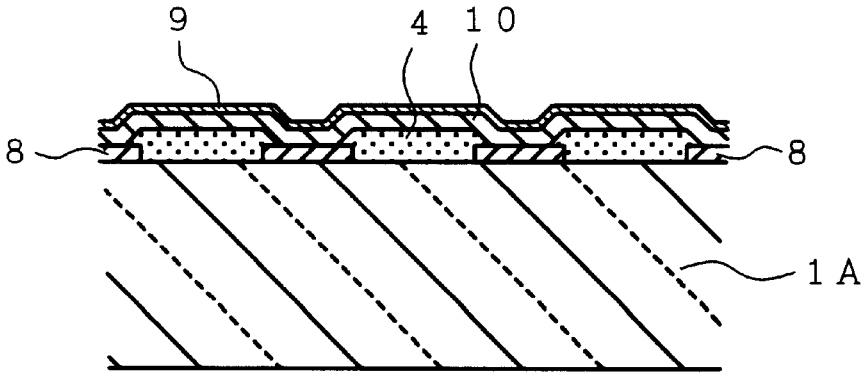
FIG. 4 is a cross section showing the fluorescent screen of this invention in the process of manufacture.

As shown in FIG. 4, the metal film 9 is formed, as mentioned above, to cover the phosphor layers 4 and the black matrix layer 8 by first vapor-depositing the metal over an organic film resin 10, which has been applied over the entire area of the phosphor layer 4 and the black matrix layer 8, and then by removing the organic film resin 10 through baking. There are two methods for forming the organic film.

The first method of forming the organic film is a lacquer filming method that uses a solvent-based acrylic resin as a filming solution. After the phosphor layer is completed, the interior of the panel is wetted by water or a liquid containing a small amount of polymer dissolved in water. Next the filming liquid is applied and dried and aluminum is vapor-depositing. The solvent used includes toluene and ethyl acetate. The solvent-based acrylic resin has a poor affinity with water. Taking advantage of this property, the inner surface of the panel is wetted in advance to be able to reduce the amount of solvent-based acrylic resin required.

The use of two kinds of liquid, water to wet the panel and solvent-based acrylic resin, makes control of the film thickness difficult. The metal film formed through the use of the solvent-based acrylic resin has a small number of contact points with the phosphor film and is thus easily peeled off. Further, because a volatile solvent is used, many problems arise, such as environmental pollution and the need for an explosion-proof facility. When a solvent-based acrylic resin is used in forming the metal film, the metal film covers and straddles phosphor dots of different colors. Hence, when a phosphor dot of one color illuminates, the light leaks into phosphor dots of other colors, causing a color bleed or what is called a halation phenomenon.

The second method of forming the organic film is an emulsion filming method that uses an aqueous acrylic emulsion as the filming solution. After the phosphor layer is completed, the filming liquid is applied and dried and aluminum is vapor-deposited. The filming liquid penetrates into the phosphor layer and thus a large amount of acrylic emulsion is used. Because the organic film resin is used in large amounts, a large volume of gas is produced when burning the resin, giving rise to the blister problem.

The second method, however, uses only one kind of liquid for forming the film and therefore the thickness of the film can be controlled easily. In addition, because the metal film formed by using an acrylic emulsion has an increased number of contact points with the phosphor layer, it is not easily peeled off. Further, when the metal film is formed by using an acrylic emulsion, the metal film covers the phosphor dots one by one separately, making the halation phenomenon unlikely to occur.

Either the first method or the second method may be used as long as the cathode ray tube has a metal film of the above described structure. The metal film structure is particularly effective where the second method is used even though it may give rise to a blister problem.

The metal film 9 has a shape following (or tracing) the shape of the, organic film surface and is formed with cracks at the same locations as those of the organic film. Next, the organic film resin 10, particularly the one formed by an acrylic emulsion, to produce the above described metal film structure will be explained.

The filming solution to form the organic film resin 10 is made of an acrylic emulsion and a water-soluble polymer. A plasticizer may be added as required. The acrylic emulsion preferably contains methyl methacrylate and acrylate as major components and has grain diameters of 50 nm to 100 nm. The preferred water-soluble polymer includes those that have a thickening effect on an acrylic emulsion, such as polyvinyl alcohol, polyacrylic acid, copolymer of acrylate and acrylic acid, polyacrylamide, methyl cellulose, carboxymethyl cellulose, hydroxyethyl cellulose and hydroxypropylmethyl cellulose. The plasticizer preferably includes glycols, glycerin, and phthalate.

To obtain the metal film 9 conforming to the above-described object of this invention by using the above-described filming solution, control needs to be made of (1) the hardness of the acrylic emulsion and (2) the fluidity of the filming aqueous solution. The hardness of the acrylic emulsion is a critical point in the formation of cracks. The proposed effective methods of forming cracks include the addition of hydrogen peroxide or cellulose acrylate.

The inventors have found that cracks sufficient to prevent, blisters can be formed even by the use of acrylic emulsion alone as long as the acrylic resin can provide a relatively hard film. In that case, a filming solution containing only an acrylic emulsion diluted with water is very likely to produce an uneven coat, making it difficult to form a uniform organic film over the phosphor pattern on the entire panel surface. Increasing the amount of film resin to produce a uniform organic film will likely result in blisters. It is therefore very difficult for the conventional filming solution to meet both of the blister and brightness requirements.

To prevent blisters and still produce bright images, the addition of a water-soluble polymer that has a thickening effect on the acrylic emulsion (i.e., increasing the viscosity of acrylic emulsion) is effective. When, however, the mutual action between the acrylic emulsion and the water-soluble polymer is too strong, it is found that the densified acrylic emulsion and the water-soluble polymer coagulate during the drying process after the application of the film liquid, forming many cracks or pin holes on the upper part of the phosphor, thereby failing to produce a desirable metal film.

The addition of a water-soluble polymer in the filming solution thickens the acrylic emulsion to prevent uneven coating and to produce a uniform film with a small amount of film resin, and also improves the allowable margin for blisters. However, relying on the water-soluble polymer for thickening induces coagulation during the process of drying and densifying, causing many cracks also on the upper part of the phosphor dots and degrading the quality. It has been found that these conflicting conditions can be dealt with effectively by increasing the viscosity of the acrylic emulsion itself, while keeping the amount of water-soluble polymer to be added as small as possible.

In the following, specifications on an acrylic emulsion required to produce a desired metal film will be described.

Figure 5:
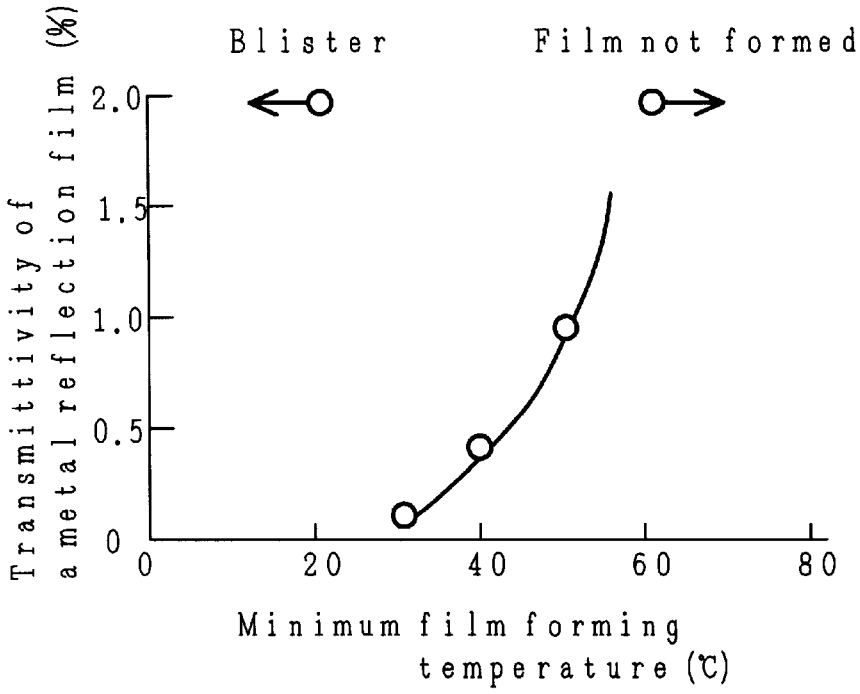
FIG. 5 is a graph showing the organic film resin forming temperature versus metal film transmittivity, the organic film resin and the metal film being used in the manufacture of the cathode ray tube of this invention.

First, the control of the hardness of the acrylic emulsion is performed as follows. An index for acrylic emulsion hardness includes a minimum film forming temperature. FIG. 5 shows the relation between the minimum film forming temperature and the transmittivity of a metal film. It was found that the minimum film forming temperature required to produce a metal film with a desired transmittivity of 0.1% to 1.0% ranges from 30° C. to 50° C. When the minimum film forming temperature is less than 30° C., the formed organic film is soft, so that cracks are considered unlikely to develop in the organic film. In reality, however, the metal film was formed with cracks due to the generation of blisters and its transmittivity exceeded 1.0%. When the minimum film forming temperature is higher than 50° C., the organic film becomes too hard, increasing the number of cracks. Hence, the transmittivity exceeded 1.0%.

Figure 6:
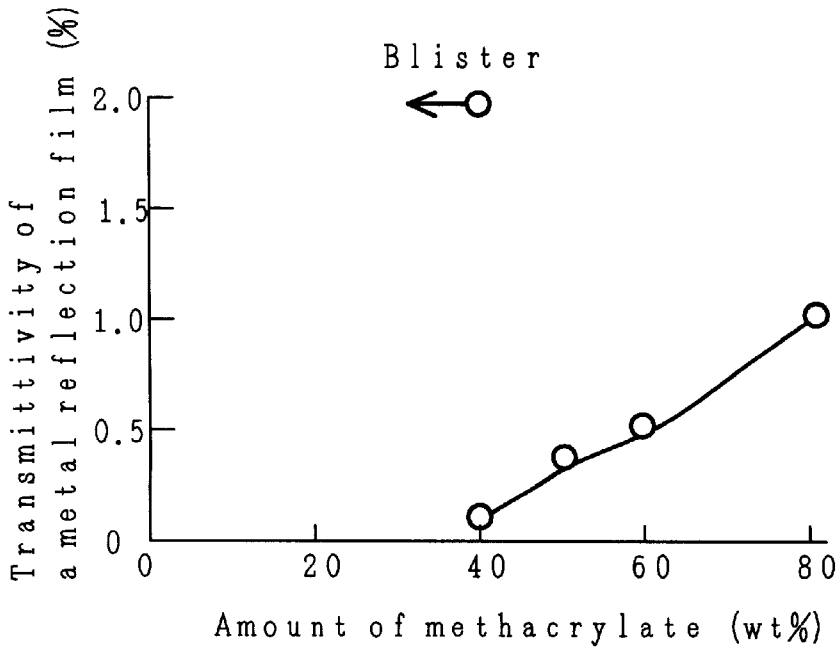
FIG. 6 is a graph showing the amount of methyl methacrylate to be blended versus metal film transmittivity, the methyl methacrylate, and the metal film being used in the manufacture of the cathode ray tube of this invention.

It is also found that, for the acrylic emulsion to achieve an appropriate, hardness, methyl methacrylate should be used as the main component of the acrylic emulsion. Methyl methacrylate has a glass transition point in a high temperature region higher than 80° C. and has sufficient hardness to cause cracks in the metal film. FIG. 6 shows the relation between the amount, of methyl methacrylate to be added and the transmittivity of a metal film. At 40% by weight of methyl methacrylate, the metal film was formed with blisters, so that methyl methacrylate needs to be added in amounts of at least 40% by weight. It is found that the required amount of methyl methacrylate to be added during the making of the emulsion in order to reliably prevent blisters is 50% by weight or higher. When methyl methacrylate was in excess of 80% by weight, the transmittivity of the metal exceeded 1.0%. As the copolymerization components of the acrylic emulsion, butyl acrylate was used only when the methyl methacrylate was 80% by weight and, when the blending amount was other than that, ethyl acrylate was used.

The transmittivity of the metal film was obtained by peeling the metal film with caution so that cracks will not propagate from the phosphor layer into the metal film and by measuring the transmittivity of the metal film using a spectrophotometer. The wavelength used was 550 nm. The range of the transmittivity from 0.1% to 1.0% was derived by changing the specifications of the filming solution, applying the respective solutions to the panel portion and examining and observing the brightness and the blister condition. If the metal film is formed so that its transmittivity is less than 0.1%, blisters are produced partly over the panel inner surface with the result that the portions where the blisters are formed become dark. If the metal film is formed so that its transmittivity is higher than 1.0%, the screen as a whole becomes dark. Therefore, it is preferred that the metal film have cracks and pin holes to such an extent that the transmittivity is in the range of 0.1% to 1.0%.

Next, the method of providing the thickening action will be described. The acrylic emulsion is copolymerized with acrylic acid and/or methacrylic acid so that it possesses carboxylic acid, which in turn enhances its ability to thicken with the addition of the water-soluble polymer. FIG. 7 shows the relation between the amount of methacrylic acid compounded and the transmittivity of the metal film. FIG. 7 shows, in particular, the cases for 50% and 80% by weight of methyl methacrylate, (MMA) in the emulsion. From this figure, it is seen that when the amount of methyl methacrylate (MMA) is set in the range of 50–80% by weight, the transmittivity of the metal reflection film can be made lower than 1.0% by setting the amount of methacrylic acid to be added in the range of 1–19% by weight.

We will explain about the amount of methyl methacrylate to be compounded when the minimum film forming temperature is controlled in the range of 30° C. to 50° C. When the blending amount of methyl methacrylate is small in a range of 50–60% by weight, ethyl acrylate is used as a copolymerization component. Ethyl acrylate has a higher thickening effect than methyl methacrylate, and thus the target requirement was met in a region where the blending amount of methacrylic acid is small. Conversely, when the blending amount of methyl methacrylate, is high at 80% by weight, butyl acrylate and 2-ethylhexyl acrylate are used as the copolymerization component. Because acrylate has a weaker thickening effect than ethyl acrylate and its blending amount is small, a target performance was not obtained unless the blending amount of methacrylic acid was set high. Though influenced by the compounding ratios of methyl methacrylate, and other acrylic monomers, the blending amounts of acrylic acid and/or methacrylic acid are appropriate if they fall in the range from 3 wt% to 15 wt%.

Next, an effective means for forming more metal film cracks on the side portions of the phosphor pattern than on the upper portion of the pattern will be described. FIG. 8 tabulates fluid characteristics of a filming solution and states of a metal film when the filming solution contains a varying concentration of hydroxyethyl cellulose, or a water-soluble polymer, mixed in acrylic emulsion with a varying amount of methacrylic acid.

Acrylic emulsion has a dilatancy liquid characteristic. The dilatant liquid is generally said to be a liquid that cannot easily be coated and can easily cause radial unevenness when actually coated. As a water-soluble polymer is added to this liquid, the filming solution changes to a dilatancy liquid, to a Newtonian liquid and to a pseudoplastic liquid because the water-soluble polymer has a pseudoplastic liquid characteristic. The amount of water-soluble polymer added to the filming solution was controlled so that the fluid characteristic of the filming solution fell in the range between Newtonian liquid and slightly pseudoplastic liquid. Then, a uniform organic film was able to be formed over the phosphor pattern on the entire panel and a metal film was obtained which has no blisters and more cracks formed on the side portions of the phosphor pattern than on the top portion of the pattern. By increasing the amount of carboxylic acid in acrylic emulsion, it was confirmed that the addition of a small amount of water-soluble polymer can prevent blisters.

The fluid characteristic can be checked by measuring the viscosities at two different rates of strain. When the viscosity measured at a low rate, of strain is lower than the viscosity measured at a high rate of strain, the liquid of interest is a dilatancy liquid. When the viscosity measured at, a low rate of strain is higher than the viscosity measured at a high rate of strain, the liquid is a pseudoplastic liquid. When the viscosities at a high and at a low rate of strain are equal, the liquid under consideration is a Newtonian liquid.

With the cathode ray tube construction as described above, the decomposed gas generated during the baking of the organic film resin can be released through many cracks formed in the metal film on the side portions of the phosphor layer. thus preventing formation of blisters without deteriorating the, formed state, of the metal film.

Although the cathode ray tube described above is for color images, the foregoing description is not limited to color cathode ray tubes, but can also be applied to black-and-white ones.

While the cathode ray tube described above has a phosphor layer arranged in a dot array, this invention is not limited to this type of phosphor screen, but can also be applied to a Phosphor layer screen of a stripe array type.

As can be seen from the foregoing description, the cathode ray tube of this invention can be formed with a metal film that can prevent the blister phenomenon and a reduction in luminance.

What is claimed is:

1. A cathode ray tube comprising a metal film formed to cover a phosphor layer consisting of phosphor areas on an inner wall of a panel portion of an envelope, wherein the metal film is formed over an organic film resin applied to the phosphor layer, the organic film resin is baked and removed so that the metal film covers the phosphor layer, and cracks are formed in the metal film in a greater number on side portions of the phosphor areas of the phosphor layer than on an upper portion of the phosphor areas.

2. A cathode ray tube according to claim 1, wherein the number and size of the cracks in the metal film are such that the metal film has a transmittivity in a range of 0.1% to 1.0%.

3. A cathode ray tube comprising: a panel portion having a black matrix layer, a phosphor layer consisting of phosphor areas and a metal film, all formed over the inner surface thereof; a neck portion housing electron guns for emitting electron beams; and a funnel portion connecting the panel portion and the neck portion; wherein the metal film is formed above the phosphor layer and has holes in a part thereof, with the total area of the holes on the side surface portions of the phosphor layer areas being larger than that on the upper surface portion thereof.

4. A cathode ray tube comprising: a plurality of openings demarcated by a black matrix layer on an inner surface of a panel; and a phosphor layer having an area of phosphor laminated in each of the plurality of openings; wherein a metal film having holes formed in a part thereof is formed above the phosphor layer provided in the openings of the black matrix layer and the holes in the metal film are larger on side surface portions of each area of phosphor than on an upper surface side thereof.

* * * * *